US007669257B2

(12) United States Patent
Swihart et al.

(10) Patent No.: US 7,669,257 B2
(45) Date of Patent: Mar. 2, 2010

(54) BEDDING ASSEMBLY

(75) Inventors: Clark Swihart, Columbus, NE (US); Jerry Castro, Ceres, CA (US); Melodee Brunken, Columbus, NE (US)

(73) Assignee: CAS Enterprises, Inc., Columbus, NE (US)

( * ) Notice: Subject to any disclaimer, the term of this patent is extended or adjusted under 35 U.S.C. 154(b) by 0 days.

(21) Appl. No.: 12/319,818

(22) Filed: Jan. 12, 2009

(65) Prior Publication Data

US 2009/0178197 A1 Jul. 16, 2009

Related U.S. Application Data

(60) Provisional application No. 61/010,842, filed on Jan. 11, 2008.

(51) Int. Cl.
*A47C 9/02* (2006.01)
*A47G 9/00* (2006.01)

(52) U.S. Cl. ..... 5/496; 5/502

(58) Field of Classification Search ..... 5/496, 5/497, 502

See application file for complete search history.

(56) References Cited

U.S. PATENT DOCUMENTS 3,083,378 A * 4/1963 Pursell ..... 5/498
3,179,958 A * 4/1965 Carris ..... 5/496
5,099,531 A * 3/1992 Schmier ..... 5/692
5,208,926 A * 5/1993 Stackhouse ..... 5/482
5,321,862 A * 6/1994 Campbell ..... 5/482
5,325,554 A * 7/1994 Lewis ..... 5/498
6,098,219 A * 8/2000 Milber ..... 5/194
6,134,730 A * 10/2000 Evanson ..... 5/482
2007/0101496 A1 5/2007 Ho
2007/0113341 A1 5/2007 Ho
2007/0118988 A1 5/2007 Ho

* cited by examiner

*Primary Examiner*—Peter M Cuomo
*Assistant Examiner*—Brittany M Wilson
(74) *Attorney, Agent, or Firm*—Suiter Swantz pc llo

(57) ABSTRACT

A bedding assembly includes a fitted sheet forming opposing side panels when engaging a mattress and including at least one fastener positioned longitudinally along at least one of the fitted sheet opposing side panels. The bedding assembly also includes a top sheet forming opposing side panels when engaging a mattress and including at least one complimentary fastener positioned longitudinally along at least one of the top sheet opposing side panels, the at least one complementary fastener of the top sheet substantially aligning with the at least one fastener of the fitted sheet.

5 Claims, 5 Drawing Sheets

BEDDING ASSEMBLY

CROSS-REFERENCE TO RELATED APPLICATIONS

The present application claims the benefit under 35 U.S.C. § 119(e) of U.S. Provisional Application Ser. No. 61/010,842, filed Jan. 11, 2008. Said U.S. Provisional Application Ser. No. 61/010,842 is herein incorporated by reference in its entirety.

FIELD

The present invention generally relates to the field of bedding, and more particularly to a bedding assembly comprising longitudinal fastening capability.

BACKGROUND

Bed sheets known in the art typically include a flat or fitted sheet that may be placed over a mattress and mattress cover. An optional second sheet (also referred to as a top sheet) may be placed on top of the bed sheet located on the mattress. A person may then sleep between the flat or fitted sheet and the top sheet. A comforter, blanket, quilt, or the like is often added on top of the top sheet as additional layering. A commonly used type of fitted bed sheet is typically sewn to fit the shape of the mattress and comprises elastic around the edges to keep the edges of the sheet tucked under the mattress. The elastic edges provide a convenient means to ensure the fitted sheet remains on the mattress, such as during use.

It is often desirable to maintain or reintroduce a neat bedding appearance, such as after the bedding is pulled out of place during use. The desirable appearance may be commonly referred to as a made bed. A made bed may take many forms, but typically involves the top sheet positioned flatly upon the flat or fitted sheet, and may involve organized folding of the top sheet, comforter, blanket, quilt, or the like.

SUMMARY

A bedding assembly includes a fitted sheet forming opposing side panels when engaging a mattress and including at least one fastener disposed longitudinally along at least one of the fitted sheet opposing side panels. The bedding assembly also includes a top sheet forming opposing side panels when engaging a mattress and including at least one complementary fastener disposed longitudinally along at least one of the top sheet opposing side panels, the at least one complementary fastener of the top sheet substantially aligning with the at least one fastener of the fitted sheet.

A bedding assembly includes a fitted sheet forming opposing side panels when engaging a mattress and including at least one fastener disposed longitudinally along at least one of the fitted sheet opposing side panels. The bedding assembly also includes a top sheet forming opposing side panels when engaging a mattress and including at least one complementary fastener disposed longitudinally along at least one of the top sheet opposing side panels, the at least one complementary fastener of the top sheet substantially aligning with the at least one fastener of the fitted sheet. The at least one fastener of the fitted sheet includes an elastic member and a fastening head.

A bedding assembly includes a fitted sheet forming opposing side panels when engaging a mattress and including a plurality of fasteners, the plurality of fasteners disposed longitudinally along at least one of the fitted sheet opposing side panels. The bedding assembly also includes a top sheet forming opposing side panels when engaging a mattress and including a plurality of complementary fasteners disposed longitudinally along at least one of the top sheet opposing side panels, the plurality of complementary fasteners of the top sheet substantially aligning with the plurality of fasteners of the fitted sheet. The position of each of the plurality of complementary fasteners substantially parallels the position of each of the plurality of fasteners. The plurality of complementary fasteners and the plurality of fasteners are configured to substantially align when engaged.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION

Figure 1:
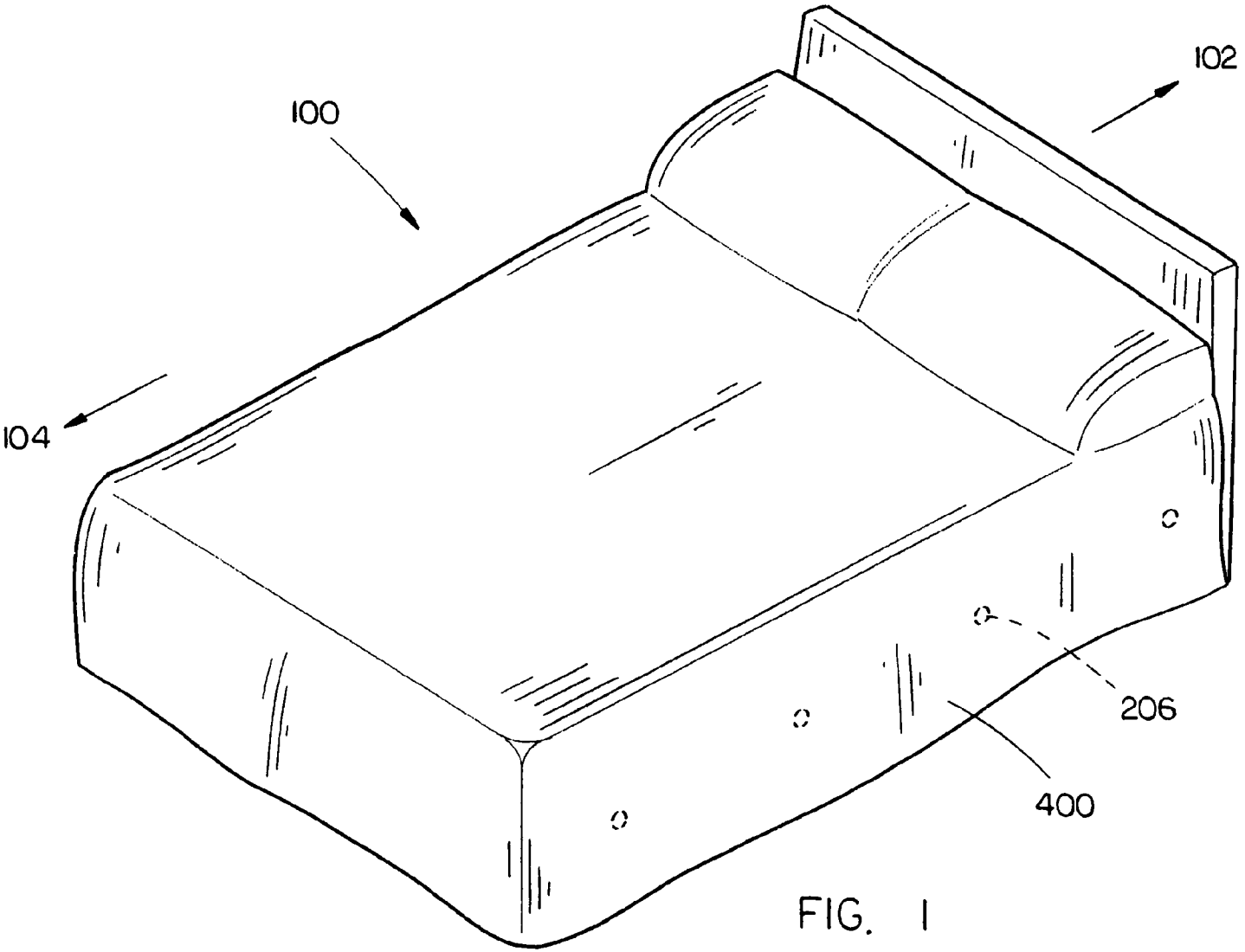
FIG. 1 is an isometric view of a bedding assembly in accordance with an exemplary embodiment of the present disclosure.
Figure 2:
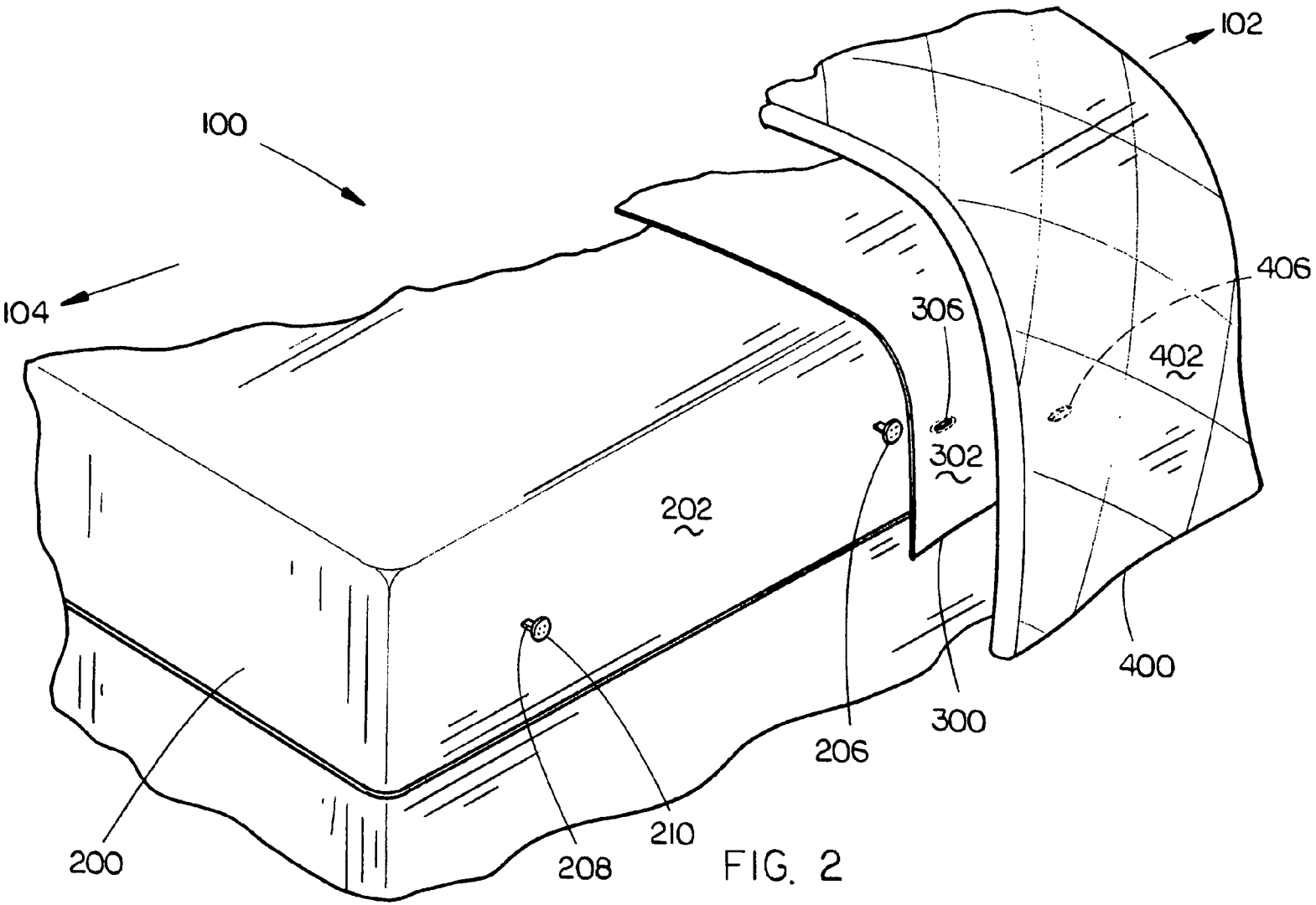
FIG. 2 is a partial exploded isometric view of the bedding assembly of FIG. 1.

Reference will now be made in detail to the presently preferred embodiments of the invention, examples of which are illustrated in the accompanying drawings.

Referring now to FIGS. 1-5, a bedding assembly 100 is depicted according to exemplary embodiments of the present disclosure. Bedding assembly 100 may include a fitted sheet 200, a top sheet 300, and a comforter 400 (e.g., a cover layer). The fitted sheet 200 is covered by the top sheet 300, which in turn is covered by the comforter 400. The fitted sheet 200 and the top sheet 300 may be comprised of materials known in the art for bedding, including cotton, linen, wool, silk, polyester, and other natural and synthetic materials, or any other type of material used to cover a mattress. Comforter 400 may include blankets, quilts, afghans, comforters, and other bedding typically used as additional covering/insulation. Fitted sheet 200 may be a flat sheet folded by a user to fit on a mattress, or may include an elastic component along a portion of the bottom edge for securing the fitted sheet to a mattress. Alternatively, fitted sheet 200 may comprise another means of securing the fitted sheet to a mattress as is known in the art, such as by including pockets into which portions of a mattress may fit, and the like. Additionally, fitted sheet 200 may comprise a drawstring around at least a portion of fitted sheet 200 to further secure fitted sheet 200 to a mattress. For example, fitted sheet 200 may comprise a drawstring around the perimeter of fitted sheet 200 for engaging side panels of a mattress. Comforter 400 may not be a necessary component of the invention, particularly where some users may prefer not to implement a comforter as additional covering. However the comforter 400 may be incorporated as a component of bedding assembly 100 and not detract from the spirit or scope of the disclosure.

When engaging a mattress, fitted sheet 200 comprises two opposing side panels 202 and 204 which run longitudinally from a head end 102 of the mattress to a foot end 104 of the mattress. Each of opposing side panels 202 and 204 may comprise at least one fastener 206. For example, fastener 206 may include an elastic member 208 and a fastening head 210. Fastening head 210 may include a button, a toggle, or any other device suitable for securing fastener 206 to a complementary fastening device. Elastic member 208 may be an elastic or semi-elastic material such that fastener 206 is not wholly inelastic, e.g., fastener 206 may move upon stresses applied to it, such as by a user during use of bedding assembly 100. However, it is contemplated that fastener 206 may comprise any suitable fastening device for securing fitted sheet 200 to top sheet 300 and/or to comforter 400, such as snaps, hook and loop fasteners, button and eyelet, lace and eyelet, toggle and grommet, zippers, sewed seams, and the like. For example, FIG. 5 displays a bedding assembly 100 utilizing hook and loop fasteners, described in detail below.

Additionally, fitted sheet 200 may include a grommet or other device through which fastener 206 passes, such as to secure the material surrounding fastener 206. For instance, fitted sheet 200 may include an elastic material secured to an interior side of fitted sheet 200 (e.g., a surface in contact with the mattress), with a toggle secured to the elastic material, the toggle and elastic material passing through a grommet included on the fitted sheet 200. Thus, the elastic and toggle may be configured to pull tight against the grommet, thereby securing a complementary fastener to the fitted sheet 200 when the toggle engages the corresponding faster, such as a grommet included on another sheet.

Figure 4:
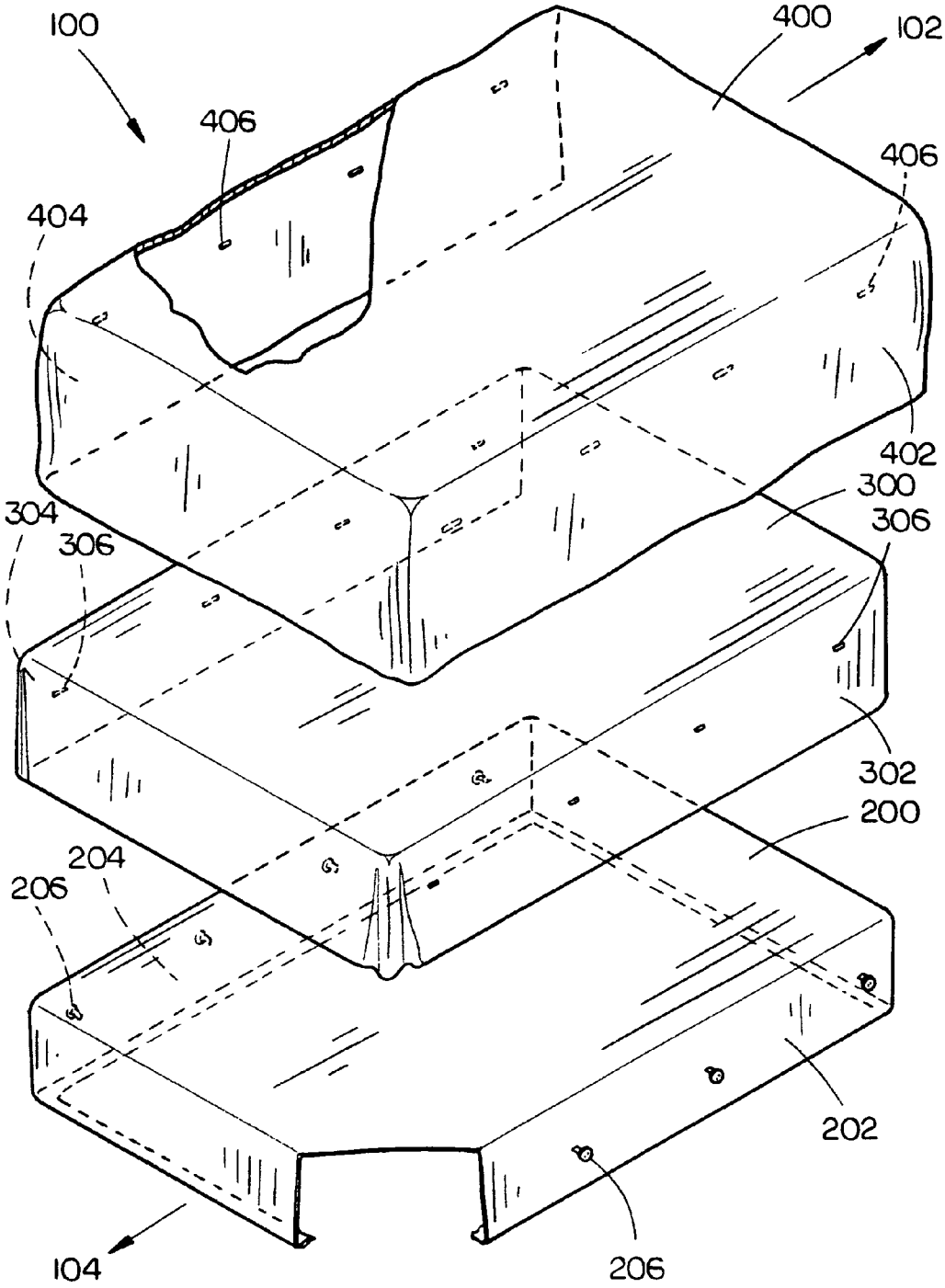
FIG. 4 is a partial exploded isometric view of the bedding assembly depicted in FIG. 3B.

According to one embodiment of the present disclosure, a plurality of fasteners 206 are longitudinally disposed along each of opposing side panels 202 and 204. In one specific embodiment (as illustrated in FIG. 4), four fasteners 206 comprising buttons as the fastening head 210 are longitudinally disposed along each of opposing side panels 202 and 204. The plurality of fasteners 206 may be separated by approximately equidistant gaps, such as in an approximately horizontal or linear manner. However, when a plurality of fasteners 206 are utilized, the fasteners 206 along each of opposing side panels 202 and 204 may be positioned relative to one another according to other schemes without departing from the spirit or scope of the disclosure.

When engaging a mattress, top sheet 300 comprises two opposing side panels 302 and 304 which run longitudinally from the head end 102 of the mattress to the foot end 104 of the mattress. Each of opposing side panels 302 and 304 may comprise at least one complementary fastener 306 that is complementary to fastener 206 of fitted sheet 200. For example, where fastener 206 comprises elastic member 208 and fastening head 210, complementary faster 306 may comprise a slot through which fastening head 210 may pass and/or engage in order to at least partially secure top sheet 300 to fitted sheet 200. Additionally, where the complementary fastener 306 is an aperture through which fastener 206 passes, the material around the aperture may be secured with a grommet or other device, such as sewn reinforced material.

The number of complementary fasteners 306 may substantially match the number of fasteners 206, and the position of the complementary fasteners 306 may substantially parallel the position of the fasteners 206 such that the complementary fasteners 306 and the fasteners 206 substantially align when engaged. For instance, spacing between complementary fasteners 306 may be substantially similar to spacing between fasteners 206. Further, fasteners 206 and complementary fasteners 306 may be disposed on opposing side panels 202 and 204 and on opposing side panels 302 and 304, respectively, such that when fitted sheet 200 engages a mattress and the fasteners of one of opposing side panels 202 and 204 engage the complementary fastener 306 of the corresponding opposing side panel 302 or 304, then the side panels with the engaging fasteners may be aligned with the mattress in a manner substantially consistent with that of a made bed.

Figure 3A:
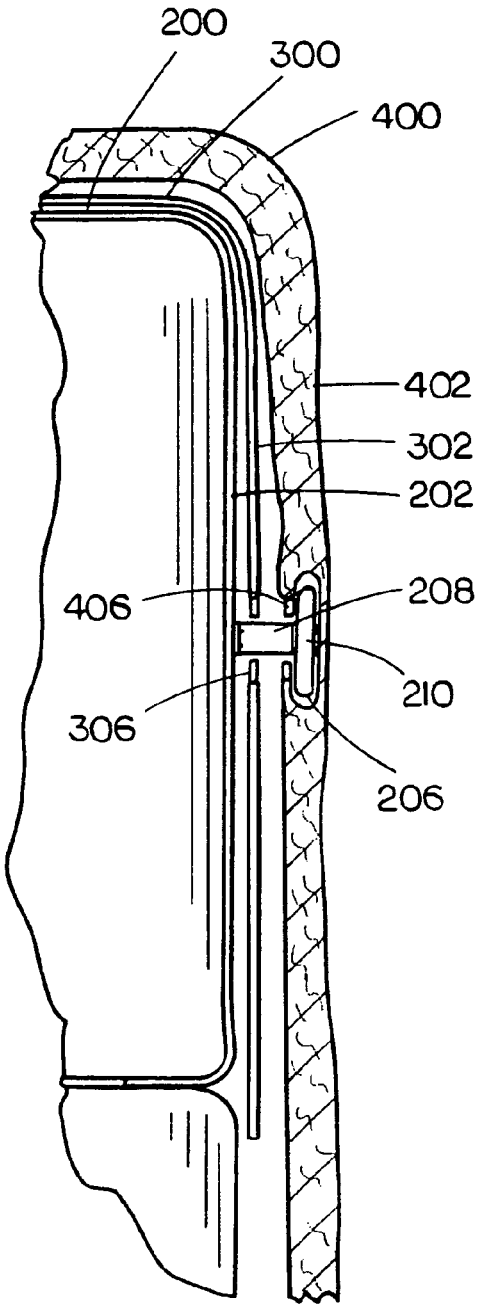
FIG. 3A is a partial sectional end view of the bedding assembly depicted in FIG. 1 wherein a fastener is engaged.
Figure 3B:
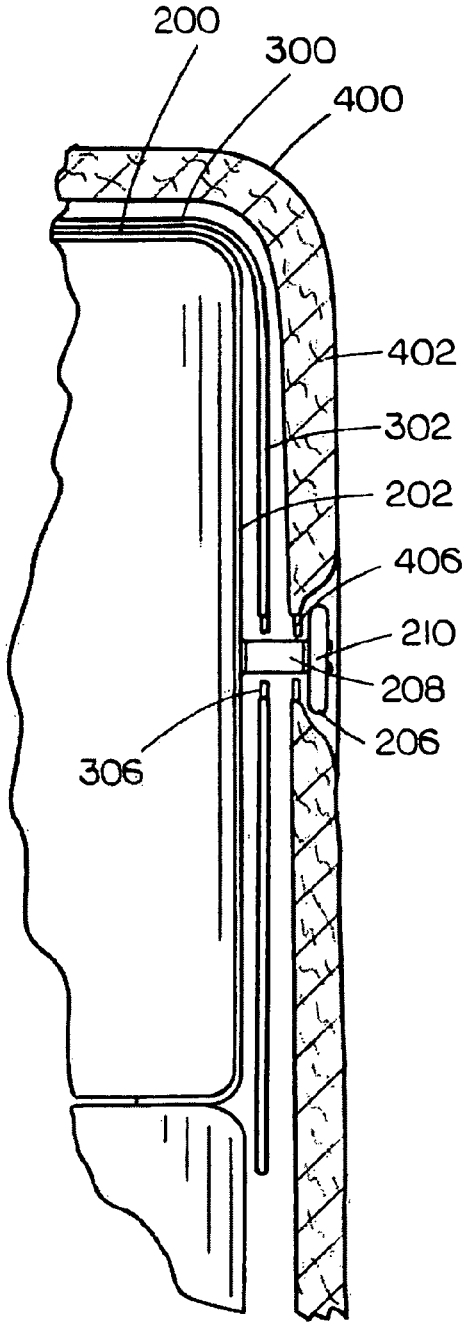
FIG. 3B is a partial sectional end view of a bedding assembly according to another embodiment of the present disclosure, wherein a fastener is engaged.

When engaging a mattress, comforter 400 comprises two opposing side panels 402 and 404 which run longitudinally from the head end 102 of the mattress to the foot end 104 of the mattress. Each of opposing side panels 402 and 404 may comprise at least one complementary fastener 406 that is complementary to the fastener 206 of fitted sheet 200. For example, complementary fastener 406 may be an aperture formed by comforter 400 through which fastener 206 may pass and engage (as depicted in FIG. 3B). The material around the aperture through which fastener 206 passes may be secured with a grommet or other device. Alternatively, complementary fastener 406 may comprise a pocket or recess for receiving fastener 206, but fastener 206 may not pass entirely through comforter 400 (as depicted in FIG. 3A). For example, complementary fastener 406 may be a pocket or recess located on an interior surface of comforter 400, but the pocket does not penetrate the entirety of comforter 400. Still alternatively, complementary fastener 406 may be located on a piece of material or other device attached to comforter 400, such as on an interior surface, which engages with fastener 206 for securing comforter 400 to fitted sheet 200. For instance, complementary fastener may be a button hole/eyelet located on a strap attached to an interior surface of comforter 400, where the fastening head 210 engages and secures fitted sheet 200 to comforter 400.

The number of complementary fasteners 406 may substantially match the number of fasteners 206, and the position of complementary fasteners 406 may substantially parallel the position of fasteners 206 such that complementary fasteners 406 and fasteners 206 substantially align when engaged. For instance, spacing between complementary fasteners 406 may be substantially similar to spacing between fasteners 206.

In one specific embodiment, fastener 206 passes through and/or engages with complementary fastener 306 and complementary fastener 406. For instance, elastic member 208 and fastening head 210 may pass through apertures formed by complementary fastener 306 and complementary fastener 406. When fastener 206 engages with complementary fastener 306 and complementary fastener 406, at least a portion of a side panel of each of fitted sheet 200, top sheet 300, and comforter 400 are aligned in a manner substantially consistent with a made bed. When all or substantially all of fasteners 206 on one of opposing side panels 202 and 204 are engaged with the complementary fasteners of top sheet 300 and/or comforter 400, top sheet 300 and/or comforter 400 may be pulled along the mattress in a direction opposite the engaged fasteners to align top sheet 300 and/or comforter 400 with fitted sheet 200 in a manner substantially consistent with a made bed. Thus, the bedding assembly may provide a user with a relatively simple means for making a bed: a user need only stand opposite the fastened/secured side of the mattress and pull the top sheet 300 and/or comforter 400 toward the user to align the top sheet 300 and/or comforter 400 in a manner substantially consistent with a made bed.

Bedding assembly 100 may utilize a traditional bedding format, including a fitted sheet, a top sheet, and a comforter. However, it is also contemplated that bedding assembly 100 utilizes a fitted sheet with a comforter directly on top of the fitted sheet, thereby foregoing a top sheet.

Figure 5:
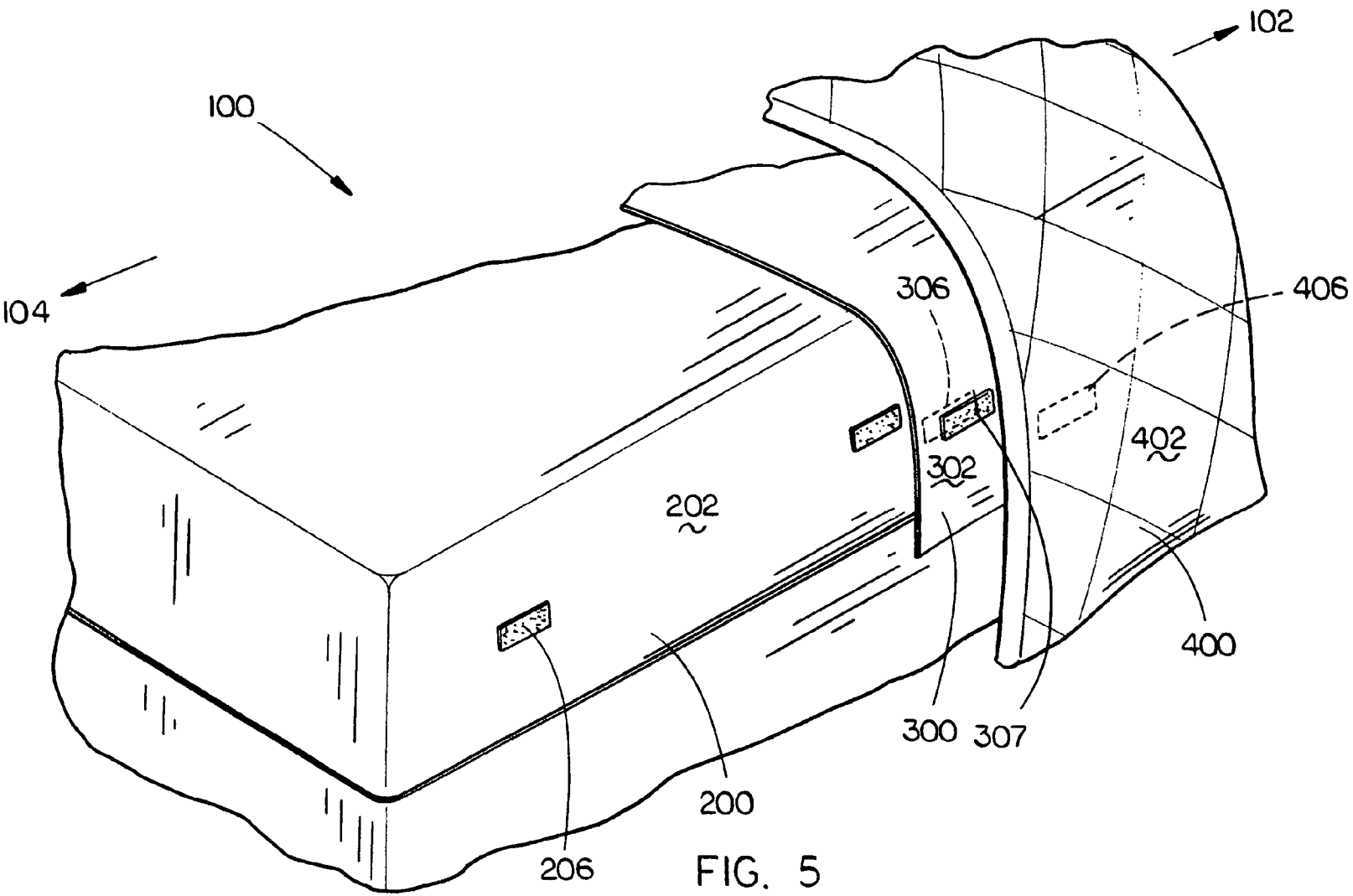
FIG. 5 is a partial exploded isometric view of a bedding assembly in accordance with a further embodiment of the present disclosure.

Referring now to FIG. 5, a partial exploded isometric view of bedding assembly 100 is illustrated in accordance with a further embodiment of the present disclosure. Bedding assembly 100 of FIG. 5 illustrates an embodiment of the disclosure which utilizes a fastener that does not pass through top sheet 300 or comforter 400, such as by using a hook and loop fastener, as depicted in FIG. 5. Alternatively, this embodiment may be utilized for other fasteners that fasten in ways other than penetrating another layer of bedding assembly 100, such as snaps, zippers, and the like. According to this embodiment, top sheet 300 comprises both a complementary fastener 306 and a fastener 307. Fastener 307 may be substantially similar to fastener 206. In this manner, complementary fastener 406 may be complementary to both fastener 206 and fastener 307. In one specific embodiment, fastener 306 and fastener 307 are located on opposite surfaces of top sheet 300, but each fastener substantially mirrors the position of the other fastener. Thus, comforter 400 may align to either or both of fitted sheet 200 or top sheet 300, depending on which fasteners are utilized or which coverings are desired.

Bedding assembly 100 utilizes fasteners that may be secured and unsecured as desired by a user. As such, bedding assembly 100 may be washed and cleaned as a complete unit, or may be separated into the individual pieces for washing (e.g., separating fitted sheet 200 from top sheet 300 from comforter 400 for separate washing and/or drying cycles). Additionally, since fitted sheet 200, top sheet 300, and comforter 400 are configured for securing and unsecuring from each other, bedding assembly 100 may include multiple versions of each of fitted sheet 200, top sheet 300, and comforter 400, such as for selecting, mixing, and matching a desired pattern, composition, style, design, and the like. For instance, one comforter of a particular style/design may be attached to fitted sheet 200 and/or top sheet 300 during one season, such as winter or fall, while another comforter of a different style/design comforter may be attached to fitted sheet 200 and/or top sheet 300 during another season, such as summer or spring. It is also contemplated that various top sheets and fitted sheets of particular styles/designs may be mixed and matched.

The position of fasteners 206 and complementary fasteners 306 and 406 on the side panels of fitted sheet 200, top sheet 300, and comforter 400 leave the foot end of the mattress unencumbered by fasteners. Thus, bedding assembly 100 allows for ease of movement at the foot end of the mattress for movement of feet or for positioning of feet outside of bedding assembly 100 at the foot end of the bed, while still maintaining an advantage of ease of making the bed after use. Such a design may be particularly beneficial for users who prefer not to have their feet encumbered or restricted during periods of rest in a bed.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A bedding assembly comprising:

a fitted sheet, the fitted sheet forming opposing side panels when engaging a mattress and including at least two fasteners disposed longitudinally along at least one of the fitted sheet opposing side panels, each fastener of said at least two fasteners including a fastening head;

a top sheet, the top sheet forming opposing side panels when engaging a mattress and including at least two complementary fasteners disposed longitudinally along at least one of the corresponding top sheet opposing side panels such that the at least two complementary fasteners of the top sheet substantially aligns with and engages the at least two fasteners of the fitted sheet, the at least two complementary fasteners of the top sheet including an aperture through which the at least two fasteners including the fastening head pass; and a cover layer, the cover layer forming opposing side panels when engaging a mattress and including at least two complementary fasteners disposed longitudinally along at least one of the corresponding cover layer opposing side panels such that the at least two complementary fasteners of the cover layer substantially aligns with and engages the at least two fasteners of the fitted sheet, wherein the at least two complementary fasteners of the cover layer engage the fastening head of the at least two fasteners of the fitted sheet as the fastening head of the at least two fasteners pass through the at least two complementary fasteners of the top sheet, each of the at least two complementary fasteners of the cover layer including a pocket on an interior surface of the cover layer and secures the fastening head of each fastener of the fitted sheet.

2. The bedding assembly of claim 1, wherein the cover layer includes one of a blanket, a quilt, a comforter, or an afghan.

3. The bedding assembly of claim 1, wherein each of the at least two fasteners are coupled to the fitted sheet with an elastic material.

4. The bedding assembly of claim 1, wherein each of the at least two complementary fasteners of the top sheet layer includes a grommet surrounding said aperture of the top sheet.

5. The bedding assembly of claim 1, wherein each of the at least two complementary fasteners of the cover layer includes a grommet surrounding said pocket on said interior surface of said cover layer.

* * * * *